US008231361B2

(12) United States Patent
Steigerwald et al.

(10) Patent No.: US 8,231,361 B2
(45) Date of Patent: Jul. 31, 2012

(54) HYDROSTATIC PUMP

(75) Inventors: Martin Steigerwald, Glattbach (DE); Burkhard Sturmer, Kleinostheim (DE)

(73) Assignee: Linde Material Handling GmbH, Aschaffenburg (DE)

( * ) Notice: Subject to any disclaimer, the term of this patent is extended or adjusted under 35 U.S.C. 154(b) by 612 days.

(21) Appl. No.: 12/427,060

(22) Filed: Apr. 21, 2009

(65) Prior Publication Data

US 2009/0269215 A1 Oct. 29, 2009

(30) Foreign Application Priority Data

Apr. 29, 2008 (DE) ..... 10 2008 021 393

(51) Int. Cl.
*F04B 49/00* (2006.01)

(52) U.S. Cl. ..... 417/213; 417/470; 60/443; 60/452

(58) Field of Classification Search ..... 417/213, 417/214, 217, 270; 91/504–506; 60/290, 60/443, 450, 452
See application file for complete search history.

(56) References Cited

U.S. PATENT DOCUMENTS

| | | | | |
|---|---|---|---|---|
| 4,559,778 | A | 12/1985 | Krusche | |
| 4,663,714 | A * | 5/1987 | Cornell et al. | 701/52 |
| 5,355,675 | A * | 10/1994 | Mayhugh et al. | 60/327 |
| 2004/0141849 | A1 * | 7/2004 | Deneir et al. | 417/32 |
| 2006/0174614 | A1 * | 8/2006 | Dong et al. | 60/444 |

* cited by examiner

*Primary Examiner* — Toan Ton
*Assistant Examiner* — Kevin Quaterman
(74) *Attorney, Agent, or Firm* — The Webb Law Firm

(57) ABSTRACT

A hydrostatic pump (1) with a variable displacement volume can be operated in a closed circuit and is driven by a drive engine (2), in particular by an internal combustion engine. To control the displacement of the pump (1), a control device (4) is provided which can be actuated as a function of the speed-dependent control pressure which is a function of the speed of the drive engine (2). To improve the control characteristics of the pump, a switchover device (35) is provided, by which the pump (1) can be switched between a speed-dependent displacement control by the speed-dependent control pressure and a volume flow-dependent delivery control, in which the control device (4) of the pump (1) can be controlled as a function of the actuation of an actuator mechanism (28).

21 Claims, 2 Drawing Sheets

HYDROSTATIC PUMP

CROSS-REFERENCE TO RELATED APPLICATION

This application claims priority to German Application DE 10 2008 021 393.4, filed Apr. 29, 2008, which is herein incorporated by reference in its entirety.

BACKGROUND OF THE INVENTION

1. Field of the Invention

This invention relates to a hydrostatic pump with a variable delivery volume which can be operated in a closed circuit and is driven by a drive engine, in particular, by an internal combustion engine. To control the delivery of the pump, a control device is provided which can be actuated as a function of a control pressure, which is a function of the speed of the drive engine.

2. Technical Considerations

Hydrostatic pumps of this general type with variable displacement volumes which are operated in a closed circuit can be used, for example, as pumps in traction drives of mobile work machines.

As a result of the control of the pump displacement as a function of the speed of the drive engine that drives the pump, such as an internal combustion engine, an automotive control system is achieved in which the pump pivots as a function of the speed of the drive engine so that on a hydrostatic traction drive, the speed of travel of the mobile work machine increases with the increasing speed of rotation of the drive engine.

A pump of the known art with an automotive control system of this type is described in DE 28 23 559 A1.

With an automotive control of a traction drive of this type, to achieve different speeds of travel at any desired speed of the drive engine, the operator actuates an "inch pedal". When the inch pedal is actuated, the pump is actuated to reduce the displacement. As a result, the speed of travel at the specified engine speed is reduced.

The actuation of two pedals, namely, a gas pedal and an inch pedal, however, requires complex operation and undue effort on the part of an operator. In particular, it requires great skill to precisely actuate a traction drive with an automotive control system.

Therefore, it is an object of the invention to provide a pump of this general type but which is provided with improved control characteristics.

SUMMARY OF THE INVENTION

The invention teaches that a switchover device is provided, by means of which the pump can be switched between a speed-dependent control of the displacement by the speed-dependent control pressure, and a volume flow-dependent control of the displacement in which the control device of the pump can be actuated as a function of the actuation of an actuator mechanism. The invention, therefore, teaches that the switchover device can be used to switch the pump between a speed-dependent displacement control and a volume flow-dependent displacement control, and, therefore, between two modes of operation with different control characteristics. In the volume flow-dependent displacement control, the displacement of the pump is controlled as a function of the actuation of an actuator mechanism, in which a corresponding actuation of the actuator mechanism can be used to set a specified displacement of the pump regardless of the speed of the drive engine. As a result, in a traction drive, it is easy to set a defined speed of travel by means of the actuator mechanism regardless of the speed of the engine, where only the actuator mechanism has to be operated. As a result of the two modes of operation and, thus, the control characteristics of the pump of the invention, it becomes possible to achieve precision control of a traction drive with a simple system of operation.

In one configuration of the invention, the control element has a slave piston which is in functional communication with a control valve which generates a control pressure that actuates a positioning piston in functional communication with a displacement volume control device, such as a swashplate. By means of the switchover device, the pressurization of the slave piston can be switched between a pressurization with a speed-dependent control pressure and a pressurization with a control pressure generated as a function of the actuation of the actuator mechanism. By means of a corresponding pressurization of the slave piston with a corresponding control pressure, it is easily possible by means of the speed-dependent control pressure to achieve a speed-dependent displacement control of the pump and a volume flow-dependent displacement control when the system is switched to the control pressure which is a function of the actuation of the actuator mechanism.

To generate the speed-dependent control pressure, it is advantageous to provide a throttle device in a delivery line of a fixed displacement pump driven by the engine. A first control pressure line that transmits the speed-dependent control pressure branches off upstream of the throttle device.

It is also advantageous to provide electrically actuated selector valves, by means of which the action on the slave piston can be controlled. When a pump is operated in a closed circuit with selector valves of this type, the pump can easily be controlled in both directions of displacement.

The switchover device can be realized in the form of an electrical solution. For this purpose, in one preferred realization of the invention, the selector valves are electrically actuated proportional valves and are in communication with the first control pressure line carrying the speed-proportional control pressure. The switchover device has a switch where, in a first switching position, the proportional valves can be actuated with a constant actuation current and, in a second switching position, with an actuation current which is generated as a function of the actuation of the actuator mechanism. For actuation of the proportional valves by constant actuator current, the proportional valves can be moved between a closed position and an open position. With the proportional valves moved into the open position, the slave piston is actuated by the speed-proportional control pressure. It thereby becomes possible to achieve a speed-dependent displacement control of the pump. When the proportional valves are actuated by an actuator current, which is a function of the actuation of the actuator mechanism, the control pressure applied to the slave piston can be varied as a function of the actuation of the actuator mechanism. As a result, a volume flow-dependent displacement control of the pump can be achieved in a simple manner.

It is particularly advantageous if the actuator mechanism is in functional communication with a potentiometer. It thereby becomes possible, by actuating the actuator mechanism, to generate an actuator current in a simple manner. For example, in the event of an increasing actuation of the actuator mechanism, a proportionally increasing actuator current is generated which results in a proportionally increasing displacement by the pump.

It is also possible to realize the switchover device in the form of a hydraulic solution. In one preferred realization of the invention, the selector valves are electrically actuated switching valves. The switchover device has a switching valve which, in a first switching position, places the selector valves in communication with the first control pressure line which carries the speed-dependent control pressure and, in a second switching position, with a second control pressure line which carries the control pressure generated as a function of the actuation of the actuator mechanism. With a switching valve of this type, it is also possible in a simple manner, in the first switching position, to achieve a speed-dependent displacement control by means of the speed-proportional control pressure which is present at the switching valves and, in the second switching position to achieve a volume flow-dependent displacement by means of the control pressure that is a function of the actuation of the actuator mechanism, which is present at the switching valves.

The actuator mechanism is appropriately in functional communication with a pressure control valve. By means of such a pressure control valve, it is possible to produce in a simple manner a control pressure which is a function of the actuation of the actuator mechanism. In particular, with an increasing actuation of the actuator mechanism it is possible to generate a proportionally increasing control pressure which affects a proportionally increasing displacement by the pump.

The pressure control valve advantageously has a first input which is in communication with a charge line, such as the delivery line of the constant-displacement pump downstream of the throttle device, and a second input which is in communication with the switching valve, as well as an output to which the second control pressure line is connected.

In one advantageous realization of the invention, the switching valve in the first switching position connects the first input of the pressure control valve with the second input, where the first control pressure line that carries the speed-dependent control pressure is in communication with the selector valves. In the first switching position of the switching valve, the speed-dependent control pressure is, therefore, present at the selector valves and in the first control pressure line. In this switched position, the pressure control valve is short-circuited, as a result of which, a speed-dependent displacement control of the pump is ensured even in the event of an actuation of the actuator mechanism.

It is particularly advantageous if the switching valve in the second switching position connects the first control pressure line which carries the speed-dependent control pressure with the second input of the pressure control valve and interrupts the connection of the first input of the pressure control valve with the second input. The second control pressure line connected to the output of the pressure control valve is connected with the selector valves. The pressure control valve is thus connected on the input side to the control pressure line that carries the speed-proportional control pressure. In the event of an actuation of the pressure control valve, this control pressure can be varied and is available at the selector valves. In the second switching position of the switching valve, it thereby becomes possible in a simple manner to achieve a volume flow-dependent displacement control.

In one embodiment of the invention, the switching valve in the first switching position connects the first control pressure line which carries the speed-dependent control pressure with the first input of a shuttle valve, which is in communication on the output side by means of a control pressure branch line with the selector valves. A second input of the shuttle valve device is in communication with the second control pressure line connected to the output of the pressure control valve. With a shuttle valve device of this type, it becomes easily possible to ensure that, in the control pressure branch line leading to the selector valves, in the first switching position of the switching valve, the speed-proportional control pressure is available, and in the second switching position of the switching valve, the control pressure generated by the actuation of the actuator mechanism is available.

The control device is appropriately provided with a limit load control function. With a limit load control function of this type, in the event of a speed limitation and, thus, a drop in the speed of the engine, the pump is moved toward a reduction of the displacement, whereby an overload and a stalling of the engine can be prevented.

It is particularly advantageous if the limit load control function is formed by a limit load control valve located in the control pressure branch line that leads from the output of the shuttle valve device to the selector valves. When the limit load control valve is located in this position, in a hydraulic solution of the switchover device, the limit load control function is effective not only with a speed-dependent displacement control of the pump but also with a volume flow-dependent displacement control of the pump.

With an electrical solution of the switchover device, it is easily possible to ensure that the limit load control function is effective with a speed-dependent displacement control of the pump and the volume flow-dependent displacement control of the pump, if the limit load control function is formed by a power limiting control valve which is located in the first control pressure line.

The control device is also advantageously provided with a power limiting function. With a power limiting function, as the delivery pressure of the pump increases, the pump is moved opposite to the control pressure present at the slave piston toward a reduction of the displacement.

If the power limiting function is formed by additional pistons of the slave piston which are acted on by the delivery pressure, a power limiting function can be achieved both with the speed-dependent displacement control as well as the volume flow-dependent displacement control of the pump of the invention.

The actuator mechanism is particularly advantageously realized in the form of a gas pedal or accelerator pedal which is in functional communication with a speed control device of the drive engine. In the first operating mode of the pump with a speed-dependent output control, the gas pedal or accelerator pedal can be used to easily set the speed of the drive engine. In the second mode of operation with a volume flow-dependent displacement control, they can be used to set the control pressure which determines the displacement.

The switchover device can be a switching valve or in the form of a switch and can be manual, hydraulic or pneumatic. It is appropriate for the switchover device realized in the form of a switching valve or switch to be actuated electrically, such as by a switching magnet.

The switchover device formed by the switch or by the switching valve can be actuated by means of an operating mode selector device. With an operating mode selector device, which can be, for example, a push-button switch or a rotary switch, the pump can easily be switched between the two modes of operation.

Particular advantages can be achieved in a hydrostatic traction drive for a mobile work machine with a hydrostatic pump of the invention which is driven by a drive engine, such as an internal combustion engine. By means of the switchover device, it is easily possible with a speed-dependent delivery control to achieve an automotive traction response or with a volumetric flow-dependent delivery control to achieve a speed control of the traction drive. As a result, the traction drive can easily be switched between a traction mode with a speed control, for example, for work cycles of the mobile work machine, or a traction mode with an automotive traction response, for example, for overland travel. Simply by switching between these two traction modes, it is possible to operate in the traction mode with a speed control of the additional drives powered by the engine at a constant r.p.m. and at a variable speed of travel. It is also possible, in the operating mode with a speed control, to have traction operation with reduced r.p.m. of the engine, whereby, in particular, fuel savings can be achieved when the engine is realized in the form of an internal combustion engine. No inch pedal is required, as a result of which the operation of the traction drive of the invention is simplified. A power limiting function and a limit load control function are also achieved in a simple manner in the traction mode with a speed control.

BRIEF DESCRIPTION OF THE DRAWINGS

Additional advantages and details of the invention are explained in greater detail below with reference to the exemplary embodiments illustrated in the accompanying schematic drawings, in which.

DESCRIPTION OF THE PREFERRED EMBODIMENTS

Figure 1:
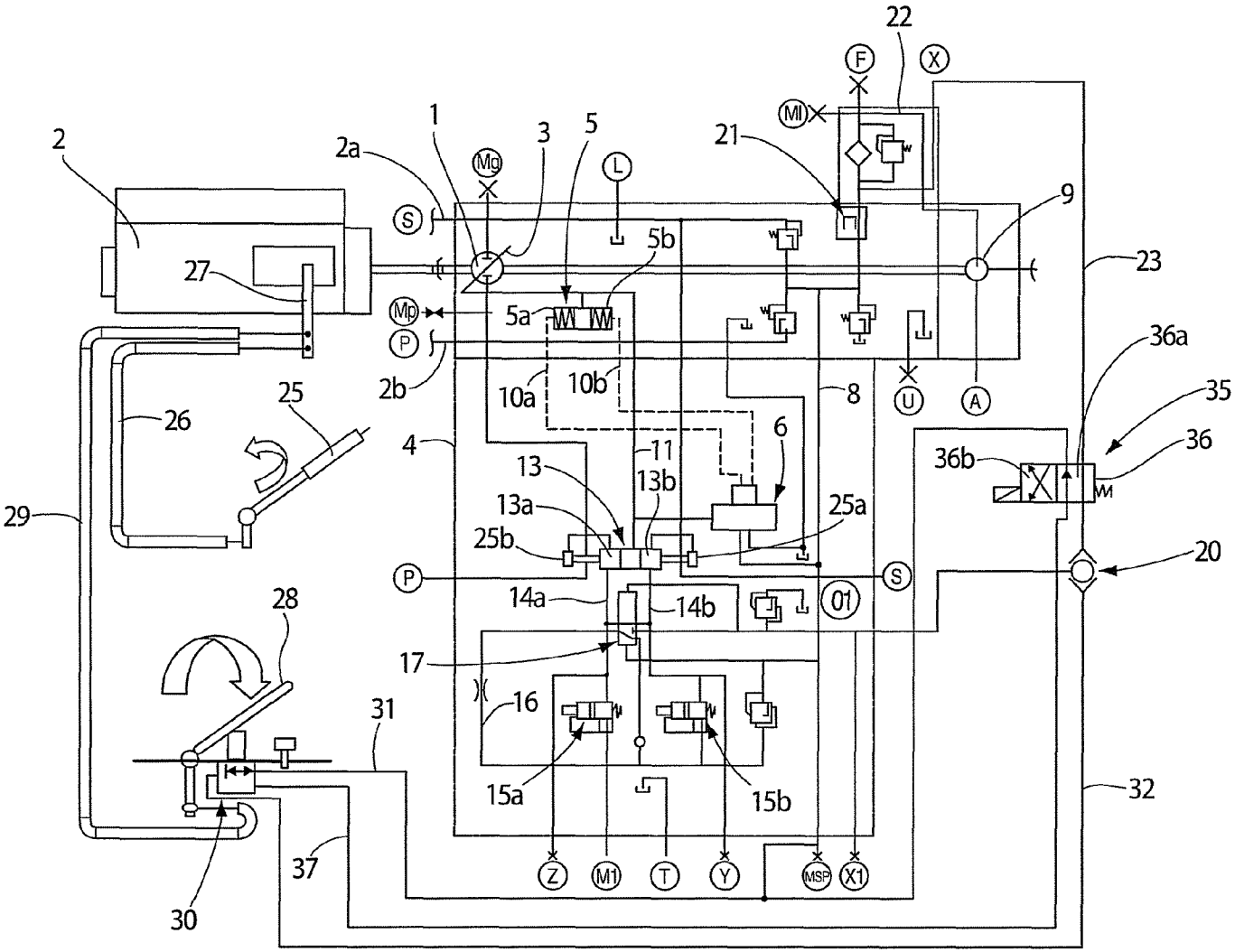
FIG. 1 is a circuit diagram of a first embodiment of a pump of the invention.

FIG. 1 is a circuit diagram of a pump 1 of the invention which is operated in a closed circuit, for example, in the traction drive of a mobile work machine.

The pump 1 is driven by a drive motor 2, for example, an internal combustion engine, and is in communication via a first delivery line 2*a* and a second delivery line 2*b*, which form the closed circuit, with at least one hydraulic motor which is not illustrated in any further detail.

The pump 1 is realized in the form of a variable displacement pump with a variable delivery volume and has a delivery volume control device 3, for example, a swashplate in the form of a cradle, which is in functional communication with a displacement volume control in the form of a control device 4 to control the displacement of the pump.

The control device 4 has a spring-centered positioning piston 5 which is in functional communication with the delivery volume control device 3 and is provided with a first control pressure chamber 5*a* and a second control pressure chamber 5*b*. In place of a positioning piston with two control pressure chambers that act in opposing directions, there can also be two positioning pistons, each with one control pressure chamber.

To control the actuation of the positioning piston 5 with a control pressure, a position-controlled control valve 6, e.g., a pilot valve, is provided. The control valve 6 has a supply pressure port which is in communication with a charge pressure line 8 of a control pressure pump which is realized in the form of a fixed displacement pump 9. The control valve 6 also has a first control pressure port which is in communication via a first control pressure line 10*a* with the first control pressure chamber 5*a* of the positioning piston 5. A second control pressure port of the control valve 6 is in communication via a second control pressure line 10*b* with the second control pressure chamber 5*b* of the positioning piston 5. The positioning piston 5 and, thus, the delivery volume control device 3, are in functional communication via a mechanical linkage 11 with the control valve 6.

The spool element of the control valve 6 is in functional communication for actuation by means of the mechanical linkage 11 with a pilot device which is realized in the form of the slave piston 13. The slave piston 13 has a first control pressure chamber 13*a* which can be pressurized with control pressure and a second control pressure chamber 13*b* which is pressurized with control pressure. For this purpose, an actuator line 14*a* is connected to the control pressure chamber 13*a* and an actuator line 14*b* to the control pressure chamber 13*b*. A spring is located in each of the control pressure chambers 13*a*, 13*b* for the spring-assisted centering of the slave piston 13.

On the slave piston 13, additional pistons 25*a*, 25*b* in communication with the delivery lines 2*a*, 2*b* are provided, by means of which a power limiting function can be achieved.

For the pressurization of the slave piston 13, selector valves 15*a*, 15*b* are provided which are in communication on the input side with a control pressure branch line 16. The selector valve 15*a* is in communication on the output side with the actuator line 14*a* which pressurizes the control pressure chamber 13*a* and the selector valve 15*b* is in communication with the actuator line 14*b* which pressurizes the control pressure chamber 13*b*.

The selector valves 15*a*, 15*b* are realized in the form of switching valves which can be actuated electrically, such as by means of a switching magnet. In the unactuated state, the control pressure chambers 13*a*, 13*b* are depressurized. When the corresponding switching magnet is actuated by means of the corresponding selector valve 15*a* or 15*b*, which is realized in the form of a switching valve, the respective actuator line 14*a* or 14*b* is connected to the control pressure branch line 16 which carries a control pressure.

The control pressure branch line 16 is in communication with the interposition of a limit load control valve 17, by means of which a limit load control function can be achieved, with the output of a shuttle valve device 20.

To pressurize the control device 4 with a speed-dependent control pressure, a throttle device 21 is located in a delivery line 22 of the fixed displacement pump 9 which is driven by the drive engine 2. A first control pressure line 23 in which a speed-dependent control pressure is present branches off from the delivery line 22 upstream of the throttle device 21.

Downstream of the throttle device 21, the delivery line 22 is connected to the charge pressure line 8.

To set the speed of rotation of the drive engine 2, a manual accelerator lever 25 is provided which is in communication, by means of a Bowden cable 26, for example, with a speed control mechanism 27 of the drive engine 2. In addition, an actuator mechanism 28 realized in the form of a gas pedal is provided, which is in communication by means of the Bowden cable 26 with the speed control mechanism 27.

The invention teaches that by means of the actuator mechanism 28, a variable control pressure which is a function of the actuation of the actuator mechanism 28 can be achieved to act on the control device 4. For this purpose, the actuator mechanism 28 is in functional communication with a pressure control valve 30 connected to a first input by a branch line 31 with the charge pressure line 8.

The output of the pressure control valve 30 is in communication with a second control pressure line 32, in which a variable control pressure can be generated which is a function of the actuation of the actuator mechanism 28. The second control pressure line 32 is connected to a second input of the shuttle valve device 20.

The invention also provides a switchover device 35 in the form of a switching valve 36, as illustrated in FIG. 1. The switching valve 36 has a first switching position 36*a* and a second switching position 36*b* and can be actuated electrically, for example, by means of a switching magnet. In the illustrated first switching position 36*a*, the switching valve 36 connects the first control pressure line 23 with a first input of the shuttle valve device 20. In the first switching position 36*a*, a branch line 37, which is connected to a second input of the control pressure valve 30, is also connected with the charge pressure line or the first branch line 31. As a result, the first input of the pressure control valve 30 is connected with the second input and, therefore, the pressure control valve 30 is short circuited.

In the second switching position 36*b* of the switching valve 36, the branch line 37, connected to the second input of the pressure control valve 30, is in communication with the first control pressure line 23. The connection of the first input of the pressure control valve 30 with the second input is also cut and the charge pressure line 8 or the branch line 31 is connected via the switching valve 36, which is in the second switching position 36*b*, to the first input of the shuttle valve device 20.

On account of the throttle device 21, a higher control pressure is thereby present in the first control pressure line 23 than in the charge line 8.

With the switching valve 36 in the first switching position 36*a*, when the actuator mechanism 28 is actuated, the speed of the drive engine is varied, whereby a speed-dependent control pressure is generated in the first control pressure line 23. This speed-dependent control pressure is present via the shuttle valve device 20 in the control pressure branch line 16. When the selector valves 15*a*, 15*b* (which are realized in the form of switching valves) are actuated, a first mode of operation with a speed-dependent delivery control of the pump 3 can be realized and, thus, during traction operation, provide a first traction mode with an automotive traction response.

The actuation of the pressure control valve 30 by the actuator mechanism 28 is not significant on account of the short-circuited pressure control valve 30 for the pressurization of the control device 4, because when the pressure control valve 30 is actuated, at the most, a control pressure in the second control pressure line 32, which is equal to the charge pressure, can be generated. By means of the shuttle valve device 20, at which the higher first speed-dependent control pressure is present at the first input, however, it can be ensured that in the first switching position 36*a* of the switching valve 36, the control pressure branch line 16 is in communication with the first control pressure line 23.

When the switching valve 36 is actuated into the second switching position 36*b*, the first control pressure line 23 is in communication with the branch line 37. As a result, when the actuator mechanism 28 and, thus, the pressure control valve 30 are actuated, a control pressure can be generated in the second control pressure line 32 which is a function of the actuation of the actuator mechanism 28. This control pressure in the second control pressure line 32 is always higher than the charge pressure present in the charge line 8 and, thus, in the branch line 31 and which is present in the second switching position 36*b* of the switching valve 36 at the first input of the shuttle valve device 20. By means of the shuttle valve device 20, it can, therefore, be ensured that in the second switching position 36*b* of the switching valve 36, the second control pressure line 32 is in communication with the branch line 16, so that when the selector valves 15*a*, 15*b* are actuated by the control pressure generated as a function of the actuation of the actuator mechanism 28, a second mode of operation can be achieved with a volume flow-dependent delivery control of the pump 3 and, thus, the traction drive has a second traction mode with a speed control.

By means of the switchover device 35, which is realized in the form of a switching valve 36 and the pressure control valve 30, the pump 3 can be switched between a speed-dependent delivery control, in which the slave piston 13 is pressurized by means of the first control pressure line 23 with a speed-dependent control pressure, and a volumetric flow-dependent delivery control in which the slave piston 13 is pressurized by means of the second control pressure line 32 with a control pressure which is a function of the actuation of the actuator mechanism 28.

The switching valve 36 of the switchover device 35 can be actuated by an operating mode selector device which is not illustrated in any further detail, such as a push-button switch or a rotary switch, so that an operator can easily switch between the two modes of operation or traction.

Figure 2:
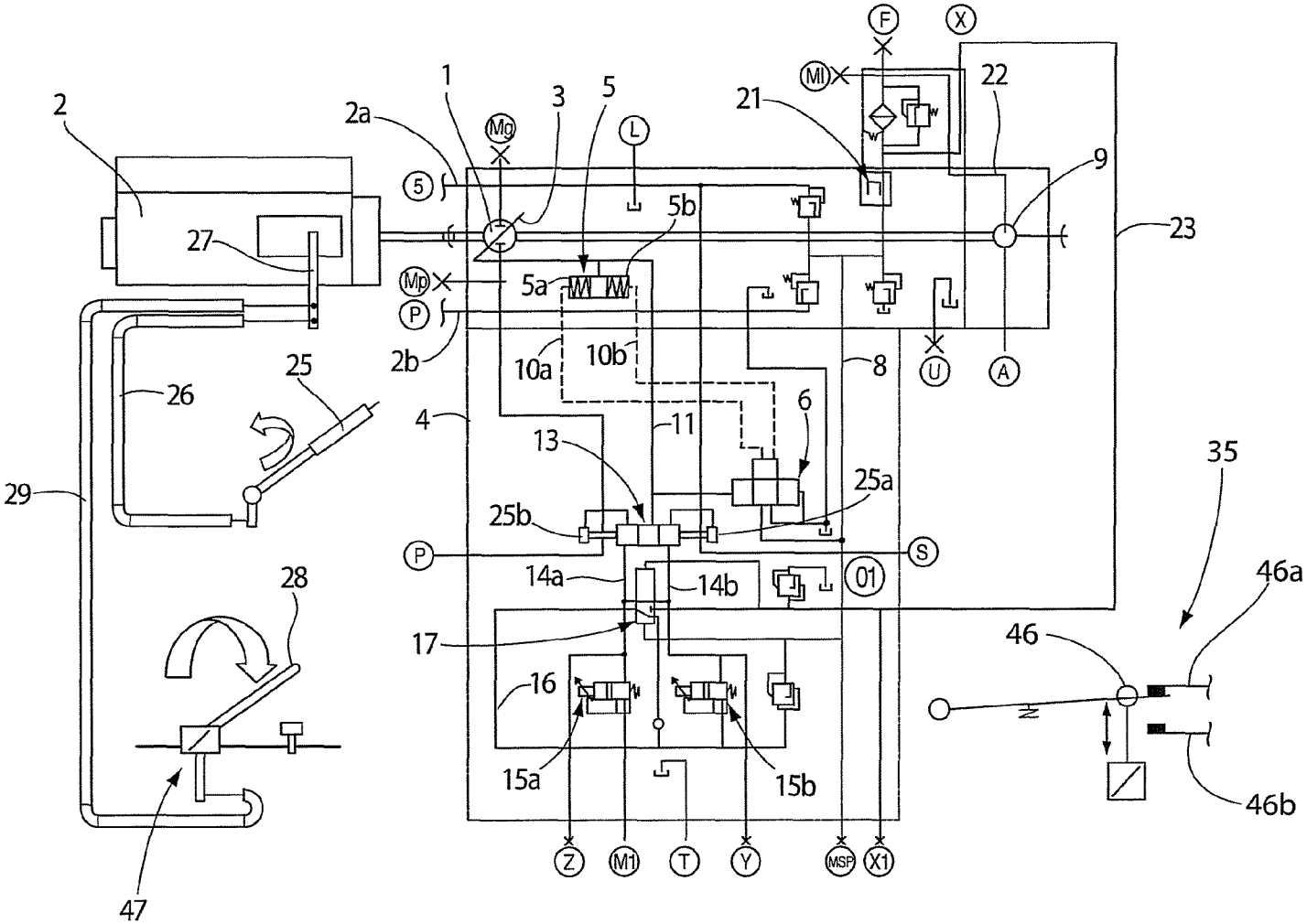
FIG. 2 is a circuit diagram of a second embodiment of a pump of the invention.

Instead of the hydraulic solution of the switchover device 35 illustrated in FIG. 1, FIG. 2 illustrates an electrical solution for the switchover device 35.

The construction of the control device 4 in FIG. 2 is essentially the same as in FIG. 1.

The selector valves 15*a*, 15*b* are proportional valves which act as throttles in intermediate positions, such as pressure reducing valves, for example, each of which can be actuated by means of a proportional magnet. The switchover device 35 thereby has a switch 46 which can be realized in the form of a relay, for example, and which in a first switching position, when the proportional magnets of the selector valves 15*a*, 15*b* are actuated, connects with a first control line 46*a* which carries a constant actuator current. In a second switching position of the switch 46, when the proportional magnets of the selector valves 15*a*, 15*b* are actuated, there is a connection with a second control line 46*b*, in which there is a proportional actuator current which is a function of the actuation of the actuator mechanism 28 by means of a potentiometer 47 which is functionally connected to the actuator mechanism 28.

The selector valves 15*a*, 15*b* are in communication on the input side directly with the first control pressure line 23 which carries the speed-dependent control pressure and in which the load limiting control valve 17 is located.

In the first switching position of the switchover device 35, which is realized in the form of a switch 46, the proportional magnets of the selector valves 15*a*, 15*b* can be actuated by a constant actuator current which is present in the control line 46. The selector valves 15*a*, 15*b* can be switched only between a closed position and an open position, so that when a selector valve 15*a* or 15*b* is actuated, the speed-proportional control pressure which is present in the first control pressure line 23 acts on the slave piston 13. In the first switching position of the switch 46, a first mode of operation can thereby be achieved with a speed-proportional delivery control of the pump 3 and, therefore, during traction operation a first traction mode with an automotive traction response.

In the second switching position of the switch 46, the proportional magnets of the selector valves 15*a*, 15*b* can be actuated with an actuator current generated by the potentiometer 47 as a function of the actuation of the actuator mechanism 28 and is present in the control line 46*b* and which is proportional to the actuation of the actuator mechanism. The selector valves 15*a*, 15*b* thereby have the function of proportional valves, so that when a selector valve 15*a* or 15*b* is actuated, the slave piston 13 can be pressurized with a control pressure which is generated as a function of the actuation of the actuator mechanism 28. Consequently, a second mode of operation with a volume flow-dependent delivery control of the pump 3 can be achieved, whereby the traction drive has a second traction mode with a speed control.

The switch 36 can thereby also be actuated by means of an operating mode selector device which is not illustrated in any further detail, and can be, for example, a push-button or a rotary switch, so that an operator can easily switch between the two modes of operation of the pump control and, thus, between traction modes of the traction drive.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic pump with a variable delivery volume which can be operated in a closed circuit and is driven by a drive engine, comprises:

a pump;

a control device configured for controlling the delivery of the pump by being actuated as a function of a speed-dependent control pressure, which depends on the speed of the drive engine; and a switchover device configured for switching the pump between a speed-dependent delivery control by the speed-dependent control pressure and a volume flow-dependent delivery control, wherein the control device of the pump is operative by the actuation of an actuation mechanism.

2. The hydrostatic pump as recited in claim 1, wherein the control device is configured to reduce the displacement of the pump in an event of a speed limitation to prevent stalling of the drive engine.

3. The hydrostatic pump as recited in claim 1, wherein the control device is configured to reduce the displacement of the pump as a delivery pressure of the pump increases.

4. The hydrostatic pump as recited in claim 1, wherein the actuator mechanism is a gas pedal or accelerator pedal operatively connected with a speed control device of the drive engine.

5. The hydrostatic pump as recited in claim 1, wherein the switchover device is configured for electrical actuation.

6. The hydrostatic pump as recited in claim 1, wherein the switchover device is configured for actuation by an operating mode selector device.

7. A hydrostatic traction drive for a mobile work machine with a hydrostatic pump as recited in claim 1 driven by an internal combustion engine.

8. A hydrostatic pump with a variable delivery volume which can be operated in a closed circuit and is driven by a drive engine, comprises:

a pump;

a control device configured for controlling the delivery of the pump by being actuated as a function of a speed-dependent control pressure, which depends on the speed of the drive engine: and a switchover device configured for switching the pump between a speed-dependent delivery control by the speed-dependent control pressure and a volume flow-dependent delivery control, wherein the control device of the pump is operative by the actuation of an actuation mechanism, wherein the control device includes a slave piston in functional communication with a control valve, which generates a control pressure that acts on a positioning piston which is in functional communication with a delivery volume control device, whereby by means of the switchover device, action on the slave piston can be switched between a pressurization with a speed-dependent control pressure and a pressurization with a control pressure which is generated as a function of the actuation of the actuator mechanism.

9. The hydrostatic pump as recited in claim 8, wherein for generation of the speed-dependent control pressure, a throttle device is located in a delivery line of a fixed displacement pump driven by the drive engine, whereby a first control pressure line which carries the speed-dependent control pressure branches off upstream of the throttle device.

10. The hydrostatic pump as recited in claim 8, including electrically actuated selector valves, by means of which the pressurization of the slave piston can be controlled.

11. The hydrostatic pump as recited in claim 10, wherein the selector valves are electrically actuated proportional valves and are in communication with the first control pressure line, which carries the speed-proportional control pressure, wherein the switchover device has a switch, wherein in a first switching position, the proportional valves are actuated with a constant actuator current and in a second switching position with an actuating current which is generated as a function of the actuation of the actuator mechanism.

12. The hydrostatic pump as recited in claim 11, wherein the actuator mechanism is in functional communication with a potentiometer.

13. The hydrostatic pump as recited in claim 10, wherein the selector valves are electrically actuated switching valves, where the switchover device has a switching valve which connects the selector valves in a first switching position with the first control pressure line which carries the speed-dependent control pressure and in a second switching position with a second control line that carries the control pressure generated as a function of the actuation of the actuator mechanism.

14. The hydrostatic pump as recited in claim 13, wherein the actuator mechanism is in functional communication with a pressure control valve.

15. The hydrostatic pump as recited in claim 14, wherein the pressure control valve has a first input which is in communication with a delivery line of the fixed displacement pump downstream of the throttle device, and has a second input which is in communication with the switching valve, as well as an output to which the second control pressure line is connected.

16. The hydrostatic pump as recited in claim 15, wherein the switching valve in the first position connects the first input of the pressure control valve with the second input, and wherein the first control pressure line which carries the speed-dependent control pressure is in communication with the selector valves.

17. The hydrostatic pump as recited in claim 15, wherein the switching valve in the second switching position connects the first control pressure line which carries the speed-dependent control pressure with the second input of the pressure control valve and cuts the connection of the first input of the pressure control valve with the second input, and wherein the second control pressure line which is connected to the output of the pressure control valve is connected with the selector valves.

18. The hydrostatic pump as recited in claim 14, wherein the switching valve in the first switching position connects the first control pressure line which carries the speed-dependent control pressure with a first input of a shuttle valve device, which is in communication on the output side by means of a control pressure branch line with the selector valves, wherein a second input of the shuttle valve device is in communication with the second control pressure line which is connected to the output of the pressure control valve.

19. The hydrostatic pump as recited in claim 10, wherein the control device includes a limit load control function, and wherein the limit load control function is formed by a limit load control valve located in the control pressure branch line that leads from the output of a shuttle valve device to the selector valves.

20. The hydrostatic pump as recited in claim 9, wherein the control device includes a limit load control function, and wherein the limit load control function is formed by a limit load control valve located in the first control pressure line.

21. The hydrostatic pump as recited in claim 8, wherein the control device includes a power limiting function, and wherein the power limiting function is formed by additional pistons of the slave piston which are actuated by the delivery pressure.

* * * * *

UNITED STATES PATENT AND TRADEMARK OFFICE

CERTIFICATE OF CORRECTION

PATENT NO. : 8,231,361 B2
APPLICATION NO. : 12/427060
DATED : July 31, 2012
INVENTOR(S) : Martin Steigerwald et al.

It is certified that error appears in the above-identified patent and that said Letters Patent is hereby corrected as shown below:

On the Title Page:
Column 2, Assistant Examiner, Line 1, “Quaterman” should read -- Quarterman --

Column 9, Line 58, Claim 8, “engine:” should read -- engine; --

Signed and Sealed this
Sixth Day of November, 2012

David J. Kappos

David J. Kappos
*Director of the United States Patent and Trademark Office*